United States Patent [19]

Inada et al.

[11] 3,943,851

[45] Mar. 16, 1976

[54] FLAT SCREEN ALIGNMENT DEVICE

[75] Inventors: Kunio Inada, Kitamoto; Morio Yamaguchi, Tokyo, both of Japan

[73] Assignee: Pilot Man-Nen-Kitsu Kabushiki Kaisha, Tokyo, Japan

[22] Filed: June 22, 1973

[21] Appl. No.: 372,756

[30] Foreign Application Priority Data

July 10, 1972 Japan ..... 47-68803

[52] U.S. Cl. ..... 101/127.1; 33/184.5; 101/DIG. 12

[51] Int. Cl.[2] ..... B41F 15/36

[58] Field of Search ..... 101/115, 126, 127.1, 128, 101/128.1, 129, DIG. 12; 33/184.5

[56] References Cited

UNITED STATES PATENTS

| | | | |
|---|---|---|---|
| 2,796,831 | 6/1957 | Heestand | 101/DIG. 12 |
| 3,098,431 | 7/1963 | Weaver | 101/126 |
| 3,192,844 | 7/1965 | Szasz et al. | 33/184.5 X |
| 3,220,331 | 11/1965 | Evans et al. | 33/184.5 X |
| 3,243,887 | 4/1966 | Zehnpfennig | 101/DIG. 12 |
| 3,288,063 | 11/1966 | Bungay, Jr. | 101/DIG. 12 X |
| 3,696,738 | 10/1972 | Walker | 101/115 X |
| 3,744,412 | 7/1973 | Grue et al. | 101/126 X |

*Primary Examiner*—Edgar S. Burr
*Assistant Examiner*—R. E. Suter
*Attorney, Agent, or Firm*—Eliot S. Gerber

[57] ABSTRACT

A screen setting apparatus accurately locks a screen in position so that reference marks of the screen come directly in line with reference marks of a printing table, which table secures a sheet material to be printed. The apparatus comprises three registration devices, a screen having reference marks thereon, a screen fixing device, and a printing table securing a sheet material to be printed and having reference marks. The three registration devices are a first registration device, the reference mark of the printing table corresponding to a fixed relationship of the second registration device (i.e., a reticle) and a third registration device. The reticle is lined up with the reference mark of the screen and then the screen is locked in opposition by connecting the screen fixing device with the first registration device.

6 Claims, 7 Drawing Figures

FLAT SCREEN ALIGNMENT DEVICE

Figure 1:
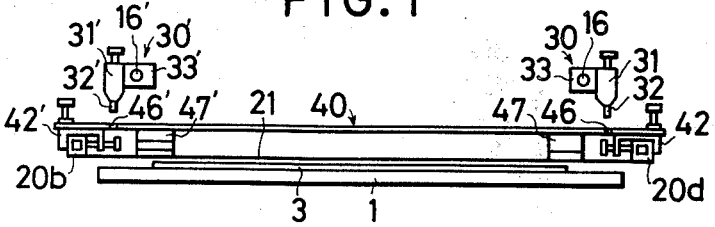

This invention relates to a device for setting a screen employed in a screen printing apparatus to a correct position with respect to a sheet material to be printed.

There exists a high demand to set the screen to the correct position of the screen printing machine, particularly where precise pattern printings are required as for instance in preparing patterns for printed circuit boards.

However, in the screen printing, a slight space or gap is usually provided between the screen and a sheet material to be printed, so as to allow the screen to be easily removed from the sheet material after the printing operation. The space, however, makes it practically impossible to correctly register reference points or marks inscribed on both the sheet material to be printed and the screen since it is quite difficult to look through the screen to register the both marks. Therefore, when an additional pattern printing is to be effected upon the sheet material which has already been printed with a pattern or patterns, it has been practiced heretofore to place the sheet material at a fixed position and then perform trial printings so as to register the reference marks on the screen to the other reference marks on the sheet material so that the former are lined up with the latter and, thereby, set the screen in position with respect to the sheet material.

It is apparent that such a registration which employs the trial printings is troublesome and time consuming, and often results in inaccuracy of the registration. Also, the effective operation of the printing apparatus must be suspended during such trial printings.

Accordingly, an object of the present invention is to provide a screen setting device in which no trial printing is needed.

Another object of the present invention is to provide a screen plate setting device which easily and precisely registers reference marks provided on a screen to other reference marks which are provided on a printing table or a sheet material to be printed, and thereby, accurately registers the screen in position with respect to the sheet material.

According to the present invention, there is provided a screen setting apparatus which is assembled with a screen printing apparatus comprising a printing table on which a sheet material to be printed is placed and set at a predetermined position, a printing machine frame above the printing table, and a screen fixing frame which will be mounted to the printing machine frame. The screen plate setting device comprises first reference means mounted to the printing machine frame with a predetermined horizontal distance and direction from first reference marks provided on the printing table or the sheet material, and a gauge means slidable along the fixing frame and temporarily secured to the fixing frame. The gauge means has second reference means adapted to cooperate with second reference marks provided on the screen, and third reference means adapted to cooperate with the first reference means. The second reference means is spaced from the third reference means in such a manner that horizontal distance and direction between the former and the latter are aligned with, or corresponded with, those of the first reference means and the first reference marks.

The screen setting device according to the present invention is so constructed that, after sliding the gauge means along the fixing frame in order that the second reference means on the gauge means may be accurately referred, or registered with the second reference marks provided on the screen, the gauge means is secured to the fixing frame. At this position, the third reference means on the gauge means are away from the second reference means with the horizontal distance and direction which are same as those between the first reference means on the printing machine frame and the first reference marks provided on or away from the sheet material, so that, when the third reference means, e.g. an aperture or a stud, and the second reference means, e.g. a reticle, the both of which are fixedly positioned with the fixed horizontal distance and direction therebetween, are respectively lined up with the first reference means on the printing machine frame and the first reference marks provided on the printing table or on the sheet material to be printed. Accordingly, when the third reference means are vertically scanned with the first reference means, the reference mark of the screen comes directly in line with, i.e., are registered with the first marks of the printing table. Thus, when the fixing frame of the screen is secured to the printing machine frame, the screen takes a correct position with respect to the sheet material to be printed.

Accordingly, in the present screen setting device, there is no need of trial printings as necessitated in the conventional setting operations, so that the setting operation of the screen becomes easy and accurate and, thereby, improves the printing efficiency.

Figure 2:
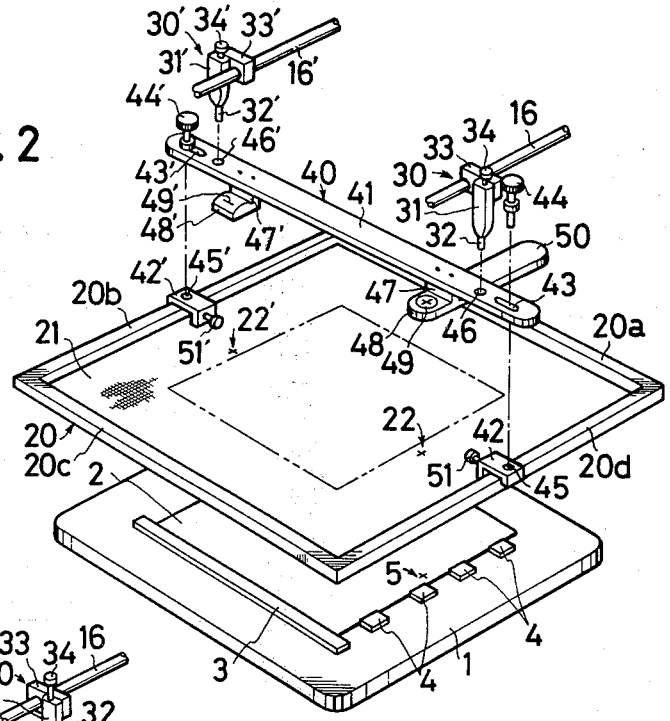
Figure 3:
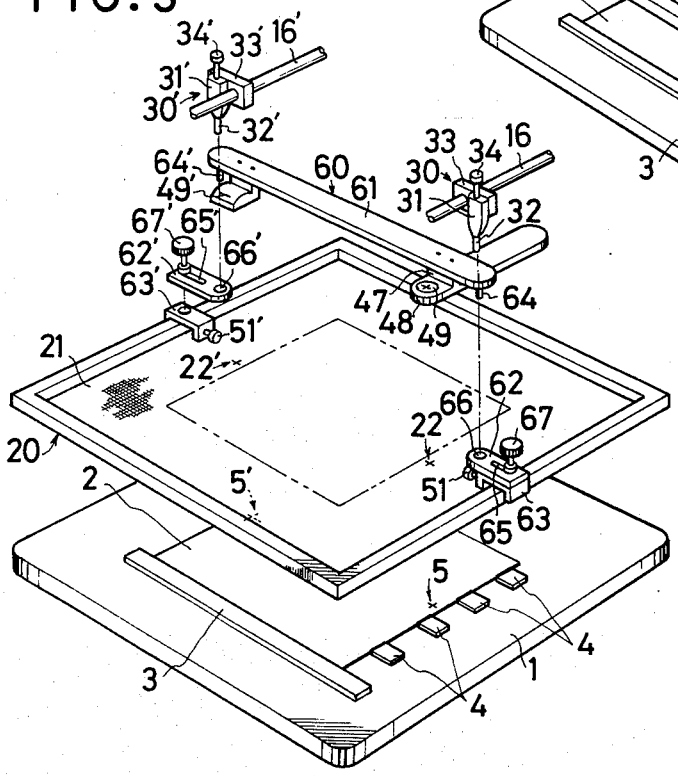
Figure 4:
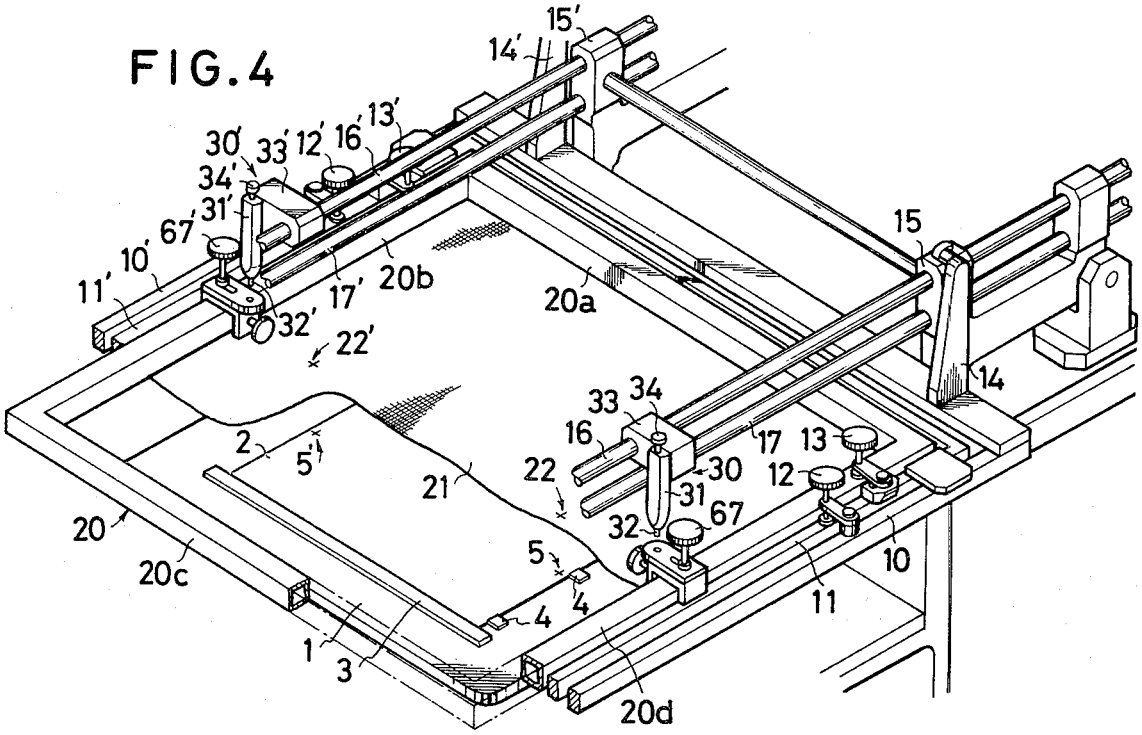
Figure 5A:
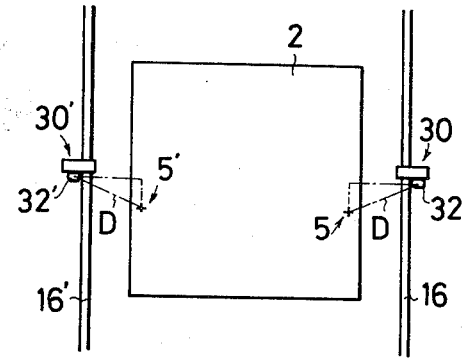
Figure 5B:
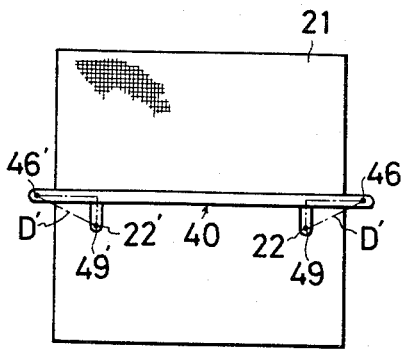

The objects and advantages of the present invention will become more apparent from the following description when taken in conjunction with the accompanying drawings, in which:

FIG. 1 is a side view showing a screen setting device according to a first embodiment of the present invention, FIG. 2 is a perspective view showing the deassembled screen setting device of the embodiment shown in FIG. 1, FIG. 3 is a perspective view showing a deassembled screen setting device of a second embodiment of the present invention, FIG. 4 is a partially exposed perspective view showing the assembled screen setting device of the embodiment shown in FIG. 3, and FIG. 5 is diagramatical plane views showing relative positions of reference points, i.e. marks and reference means, wherein FIG. 5(a) shows relative positions of reference marks on a sheet material to be printed and first reference means on a printing machine frame, and FIG. 5(b) shows relative positions of second and third reference means on a gauge means.

Figure 6:
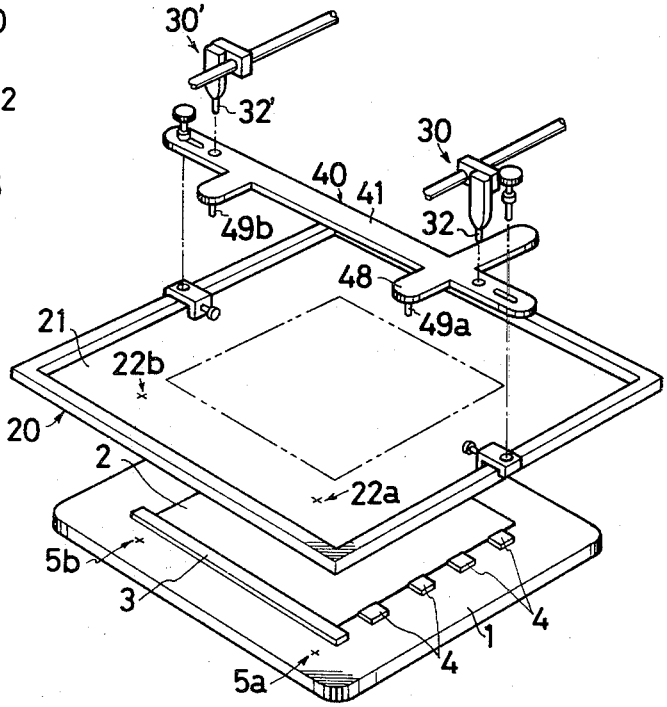

FIG. 6 is a perspective view of the device of another embodiment.

Referring first to a screen printing machine shown in FIG. 4, it comprises a printing table 1 on which a sheet material 2 to be printed is placed, a printing machine frame 10 which is above and opposing to the printing table 1, and a fixing frame, which is indicated generally by the numeral 20, for a screen 21. As shown best in FIG. 4, the printing table 1 has a side stopper 3 and front stoppers 4 both projecting above the upper surface of the printing table 1 to secure the sheet material 2 in position. Accordingly, the sheet material 2 having been transferred on the printing table 1 is forced against the stoppers 3 and 4 and, thereby, set at a predetermined position shown in FIG. 4. The sheet material 2 has two reference points, i.e. reference marks 5, 5'. The term "sheet print means" refers to the sheet material 2 on the printing table 1 or to the printing table 1 itself and the marks 5, 5' may be on the sheet material 2 or on the printing table 1.

The printing machine frame 10 has a horizontal intermediate frame 11 in which the fixing frame 20 is supported and secured through fixing members 12, 12' and 13, 13'. The printing machine frame 10 also has two brackets 14, 14' which support blocks 15, 15'. Two pairs of upper and lower beams 16, 17 and 16', 17' extend from the blocks 15, 15' above and across the frame sections 20(*a*), 20(*c*) of the fixing frame 20 (see FIG. 2). A squeegee (not shown) is movably connected to the lower beam 17, 17'.

The fixing frame 20 has the screen 21 fixed at the lower surface thereof. The screen 21 has opposing reference points, i.e. reference marks 22, 22' inscribed thereon.

Referring now to a screen setting device according to a first embodiment of the present invention shown in FIG. 2, the device comprises first reference means 30, 30' mounted to the printing machine frame 10, and a gauge means 40 slidable along the fixing frame 20 and temporarily secured to the latter by means of threaded pins 44, 44' and brackets 42, 42', a detail of which will be described later. The first reference means 30, 30' comprises a reference member 31, 31' having a lower taper end 32, 32' and a block 33, 33' slidably connecting the reference member 31, 31' to the upper beam 16, 16' of the printing machine frame 10. The reference member 31 is connected to the block 33, 33' in such a manner that the former can be moved along the beams 16, 16' 20. The lower taper end 32 of the reference member 31 is usually urged upwards by a spring (not shown) contained in the block 33, but extends downwards when an upper head 34, 34' is pushed down. The gauge means 40 comprises a gauge bar member 41 which has a length substantially equal to a distance between the frame sections 20(b), 20(d) of the fixing frame 20, and between channelled brackets 42, 42' which are slidable along the fixing frame 20*b*, 20*d*. The gauge bar member 41 has slots 43, 43' formed in the lengthwise direction at opposite end portions thereof, through which threaded pins 44, 44' pass to connect the gauge bar member 41 to the brackets 42, 42' by way of threaded holes 45, 45'. Inside of the slots 43, 43' of the gauge bar member 41 are provided reference holes 46, 46' (third reference means) through which the lower taper ends 32, 32' of the reference members 31, 31' are to be fitted when projected downwardly. The gauge bar member 41 has downwardly projecting angled members 47, 47' adjacent to the reference holes 46, 46' as well shown in FIG. 2. The angled members 47, 47' have through-holes at the horizontal foot portions thereof and transparent members having register marks 48, 48' (second reference means) reticles or cross hairs therein are attached to the through holes. One of the foot portions 48, 48' extends in the opposite direction to function as a balancing member 50 of the gauge bar member 41. The channeled brackets 42, 42' have fixing screws 51, 51' which fixedly secure the brackets at a desired position after the brackets are slid along the fixing frame to the desired position.

In operation, after setting the sheet material 2 to be printed to the predetermined position defined by the side stopper 3 and the front stoppers 4, the position of reference members 31, 31' are determined in such a manner that the horizontal distance and direction from the reference mark 5 on the sheet material 2 to the taper end 32, 32' of the reference members 31, 31' may be equal to those from the reference mark 49 on the gauge bar member 41 to the reference hole 46 in the gauge bar member 41 as shown in FIGS. 5(a) and 5(b). The gauge bar member 41 is loosely connected to the channelled brackets 42, 42' by the threaded pins 44, 44'. The brackets 42, 42' are slided along the fixing frame sections 20*b*, 20*d* until the reference marks 49, 49' on the gauge bar member 41 are registered with the reference marks 22, 22' on the screen 21. The slots 43, 43' in the gauge bar member 41 allow the latter to move in its longitudinal direction, so that the accurate registration of the both reference marks 49, 49' and 22, 22' is insured. At the position where the both reference marks 49, 49' and 22, 22' are registered, the gauge bar member 41 is firmly connected to the brackets 42, 42' by the threaded pins 44, 44'. Thus, when the fixing frame 20 is assembled to the printing machine frame 10 shown in FIG. 4 in such a manner that the taper ends 32, 32' of the reference members 31, 31' are fitted in the reference holes 46, 46' of the gauge bar member, the reference marks 22, 22' on the screen 21 become registered with the reference marks 5, 5' on the sheet material. Thus, the screen 21 takes correct printing position with respect to the sheet material 2. After securing the fixing frame 20 to the printing machine frame 10, the gauge bar member 41 is removed from the fixing frame 20 to allow the operation of the squeegee.

In a second embodiment shown in FIGS. 3 and 4, gauge means 60 comprises a gauge bar member 61, small plate members 62, 62' and channelled brackets 63, 63'. The gauge bar member 61 has a longitudinal length which is slightly smaller than a distance between opposing frame sections of the fixing frame 20. The gauge bar member 61 has downwardly projecting reference protuberances 64, 64' (third reference means) at both end portions thereof. The small plate members 62, 62' have slots 64, 65' adjacent to the ends thereof and reference hole 66, 66'. Threaded pins 67, 67' penetrate through the slots 66, 67', respectively, to secure the small plate members 62, 62' to the brackets 63, 63', and the reference protuberances 64, 64' are fitted to the reference holes 66, 66', respectively. The brackets 63, 63' and other structures are substantially same as those described and shown in connection with the first embodiment.

In operation, after setting the sheet material 2 to the predetermined position, the position of reference member 31, 31' is determined in such a manner that the horizontal distance and direction from the reference marks 5, 5' on the sheet material 2 to the taper ends 32, 32' of the reference members 31, 31' may be equal to those from the reference marks 49, 49' (second reference means) on the gauge bar member 61 to the reference protuberances 64, 64'. Then, the reference protuberances 64, 64' are fitted in the reference holes 66, 66' in the small plate members 62, 62'. The small plate members 62, 62' are connected to the channelled brackets 63, 63' by the threaded pins 67, 67'. The brackets 63, 63' are slided along the fixing frame 20 so that the reference marks 49, 49' on the gauge bar member 61 are registered with the reference marks 22, 22' on the screen 21. The slots 65, 65' in the small plate members 62, 62' allow the gauge bar member 61 to move in the longitudinal direction thereof, so the accurate registration of the both reference marks 49, 49' and 22, 22' is insured. At the position where the both reference marks 49, 49' and 22, 22' are registered, the brackets 63, 63' and the small plate members 62, 62' are firmly connected to the fixing frame 20 by the threaded pins 44, 44' and then the brackets 63, 63' are firmly fixed to the fixing frame 20 by the fixing screws 51, 51'. Then, the gauge bar member 61 is removed from the small plate members 62, 62'. Thus, when the fixing frame 20 is assembled to the printing machine frame 10 in such a manner that the taper ends 32, 32' of the reference members 31, 31' are fitted in the reference holes 66, 66' of the small plate members 62, 62', the reference marks 22, 22' on the screen plate 21 become registered with the reference marks 5, 5' on the sheet material 2.

In the second embodiment, as the gauge bar member 61 is removed after setting the small plate members 62, 62' to the determined positions, the assemblage of the fixing frame 20 to the printing machine frame 10 becomes easier. Especially, it is convenient when the fixing frame 20 having been once set to the determined position is removed from the printing machine frame 10 and is then assembled therein for reuse.

In the above-mentioned both embodiments, although the reference marks 5, 5' are inscribed upon the sheet material 2 for simplification of explanation, such reference marks or reference points may be provided outside of the sheet material as shown at reference numeral **5*a*, 5*b* in FIG. 6. In this case, also the reference points or marks 22*a*, 22*b* (FIG. 6) on the screen 21** are provided so that they will be registered with the reference marks.

Other modifications and alterations may be made as shown in FIG. 6, for example, the gauge bar member 41 and the channelled brackets 42, 42' in the first embodiment may be integral with each other. Furthermore, though the reference members 31, 31' have the taper ends 32, 32' which fit in the reference holes 46, 46' of the gauge bar member 41 or the reference holes 66, 66' of the small plate members 62, 62' shown in FIG. 3, the present invention is not limited in construction to the abovedescribed preferred embodiments of the reference members 31, 31'. Furthermore, the reference marks 49, 49' inscribed on the transparent material attached to the foot portions 48, 48' of the gauge bar member 41 can be replaced by taper-end projections like pins **49*a*, 49*b* as shown in FIG. 6.**

What is claimed is:

1. In a screen printing machine comprising a sheet print means including a printing table on which a sheet material to be printed is placed and set at a predetermined position, a printing machine frame above said printing table, a rectangular shaped screen fixing frame, having opposed frame sections, to be mounted to said printing machine frame, and a non-transparent screen attached to said fixing frame and having a pattern to be printed on said sheet material (2), the improvement of which comprising a screen setting apparatus comprising first reference points (**5, 5', 5*a*, 5*b*) provided on said sheet print means, first reference members (30, 30') slidably mounted on said printing machine frame (10) to have a predetermined distance and direction (D) from said first reference points (5, 5'), second reference points (22, 22', 22*a*, 22*b*) provided on said screen (21), a pair of brackets (42, 42', 63, 63') slidably mounted on said opposite fixing frame sections (20*b*, 20*d*), a bar member (40, 60) removably mounted on said brackets at both end portions thereof, said bar member having first reference marks (49, 49', 49*a*, 49*b*) to be vertically lined up with said second reference points on said screen, and second reference means (64, 64', 46, 46') to be vertically lined up and physically engaged with said first reference members (30, 30'**) with the horizontal distance and direction (D') between said first reference marks and said second reference means being fixedly predetermined, wherein after sliding and adjusting said first reference members along the printing machine frame in such a manner that the horizontal distance and direction (D) from said first reference points on said sheet material are made equal to those between said first reference marks and second reference means on said bar member and when said first reference marks and second reference means on said bar member are vertically lined up and physically engaged with second reference points on said screen and said first reference members, respectively, said second reference points on said screen are registered with said first reference points on said sheet print means, thereby aligning said pattern with said sheet print means.

2. A screen setting apparatus as claimed in claim 1 wherein said printing machine frame (10) has a pair of beams (16, 16') which extend above and across said screen fixing frame (20) transverse to said bar member (40, 60), and said first reference members (30, 30') are slidably mounted on said beams.

3. A screen setting apparatus as claimed in claim 2 wherein said first reference members (30, 30') are mounted on said beams (16, 16').

4. A screen setting apparatus as claimed in claim 3 wherein said bar member (40, 60) has angled members (47, 47') in which said first reference marks (49, 49') are provided.

5. A screen setting apparatus as claimed in claim 4 further comprising small plate members (62, 62') placed upon said brackets (63, 63') to be fixed thereon and provided with holes (66, 66') in which said second reference means (64, 64') are downwardly projecting protuberances at both end portions of said bar member (60) and said first reference members (30, 30') are downwardly projecting pins (32, 32').

6. A screen setting apparatus as claimed in claim 4 wherein said bar member (40) has slots (43, 43') provided at both end portions thereof, through which threaded pins (44, 44') are penetrated to allow said bar member to move in the lengthwise direction thereof and to connect said bar member (40) to said brackets (42, 42').

* * * * *